US012613054B2

(12) United States Patent
Sakano et al.

(10) Patent No.: US 12,613,054 B2
(45) Date of Patent: Apr. 28, 2026

(54) AIR CONDITIONER

(71) Applicant: Brother Kogyo Kabushiki Kaisha, Nagoya (JP)

(72) Inventors: Yuji Sakano, Toyota (JP); Shigeki Yoshida, Toyoake (JP); Yusuke Ochiai, Kiyosu (JP); Daiki Matsumoto, Nagoya (JP); Manabu Shirai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 105 days.

(21) Appl. No.: 18/584,588

(22) Filed: Feb. 22, 2024

(65) Prior Publication Data

US 2024/0191902 A1 Jun. 13, 2024

Related U.S. Application Data

(63) Continuation of application No. PCT/JP2022/031355, filed on Aug. 19, 2022.

(30) Foreign Application Priority Data

Aug. 23, 2021 (JP) ..... 2021-135885

(51) Int. Cl.
*F24F 11/84* (2018.01)

(52) U.S. Cl.
CPC ..... *F24F 11/84* (2018.01)

(58) Field of Classification Search
CPC ..... F24F 11/84
See application file for complete search history.

(56) References Cited

U.S. PATENT DOCUMENTS

| | | | |
|---|---|---|---|
| 2019/0107332 | A1 | 4/2019 | Rede et al. |
| 2022/0132699 | A1 | 4/2022 | Sakano et al. |
| 2022/0349614 | A1 | 11/2022 | Sakano et al. |

FOREIGN PATENT DOCUMENTS

| | | | |
|---|---|---|---|
| JP | 2002-206834 | A | 7/2002 |
| JP | 2012-225618 | A | 11/2012 |
| JP | 2014-092338 | A | 5/2014 |
| JP | 2016-044923 | A | 4/2016 |
| JP | 2021-018013 | A | 2/2021 |
| JP | 2021-018014 | A | 2/2021 |
| JP | 2021-113651 | A | 8/2021 |

(Continued)

OTHER PUBLICATIONS

Yuji, Air conditioner, 2020, Full Document (Year: 2020).*

(Continued)

*Primary Examiner* — Nael N Babaa
(74) *Attorney, Agent, or Firm* — Banner & Witcoff, Ltd.

(57) ABSTRACT

An air conditioner includes a sensible heat exchanger having a first path through which a first air is to flow, and a second path through which a second air is to flow, an evaporative filter, a first water supply part to supply water to the evaporative filter, and a second water supply part to supply water to the second path of the sensible heat exchanger. The second water supply part is disposed with respect to the sensible heat exchanger such that water from the second water supply part and the second air through the second path move in opposite directions. The first air is to pass through the first path of the sensible heat exchanger and the evaporative filter.

15 Claims, 4 Drawing Sheets

(56) References Cited

FOREIGN PATENT DOCUMENTS

| | | | | |
|---|---|---|---|---|
| JP | 2021-113676 A | 8/2021 | | |
| WO | WO-2020158561 A1 * | 8/2020 | ..... | F24F 1/0007 |

OTHER PUBLICATIONS

Feb. 27, 2024—(WO) International Preliminary Report on Patentabililty and Written Opinion—App PCT/JP2022/031355, Eng Tran.
Oct. 25, 2022—International Search Report—PCT/JP2022/031355.

* cited by examiner

AIR CONDITIONER

REFERENCE TO RELATED APPLICATIONS

This is a continuation application of International Application No. PCT/JP2022/031355 filed on Aug. 19, 2022, which claims priority from Japanese Patent Application No. 2021-135885 filed on Aug. 23, 2021. The entire contents of the aforementioned applications are incorporated herein by reference.

BACKGROUND ART

A known evaporative cooling type air conditioner draws in indoor air, lowers the ambient temperature using the heat of evaporation of water, and blows the cooled air into a room. The air conditioner includes air blowing means disposed in a casing, a first channel fluidly connecting an inlet and a first outlet and guiding an air flow generated by the air blowing means to the first outlet, a second channel fluidly connecting the inlet and a second outlet and guiding the air flow generated by the air blowing means to the second outlet, evaporative means disposed in the second channel for cooling the air flowing through the second channel by the heat of evaporation of water, and a heat exchanger to exchange heat between an airflow cooled by the evaporative means in the second channel and an airflow in the first channel. In the second channel provided with the evaporative means, air flowing downstream of the evaporative means has an increased absolute humidity due to unevaporated spray water which is atomized water sprayed by the evaporative means and evaporated spray water which is evaporated water. The air having increased humidity is blown out as exhaust air from the second outlet which is an exit of the second channel. The airflow cooled by the heat exchanger and flowing through the first channel is blown out as supply air from the first outlet to a space to be air-conditioned.

In the known air conditioner, the air blown by the air blowing means and flowing through the second channel passes through tubes of the sensible heat exchanger, and the air blown by the air blowing means and flowing through the first channel passes around the tubes, whereby heat is exchanged between the air flowing through the second channel and the air flowing through the first channel.

DESCRIPTION

However, the air conditioner is not designed with consideration given to the flow of water with respect to the flow of air in the evaporative means, and therefore there is concern that the cooling capacity will decrease.

Aspects of the disclosure provide an air conditioner capable of improving the cooling capacity.

According to an aspect of the disclosure, an air conditioner includes a sensible heat exchanger having a first path through which first air is to flow and a second path through which second air is to flow, an evaporative filter, a first water supply part to supply water to the evaporative filter, and a second water supply part to supply water to the second path of the sensible heat exchanger. The second water supply part is disposed with respect to the sensible heat exchanger such that water from the second water supply part and the second air through the second path move in opposite directions. The first air is to pass through the first path of the sensible heat exchanger and the evaporative filter.

Thus, the second air can be efficiently cooled, and the cooling efficiency of the air conditioner can be improved.

EMBODIMENT

Figure 1:
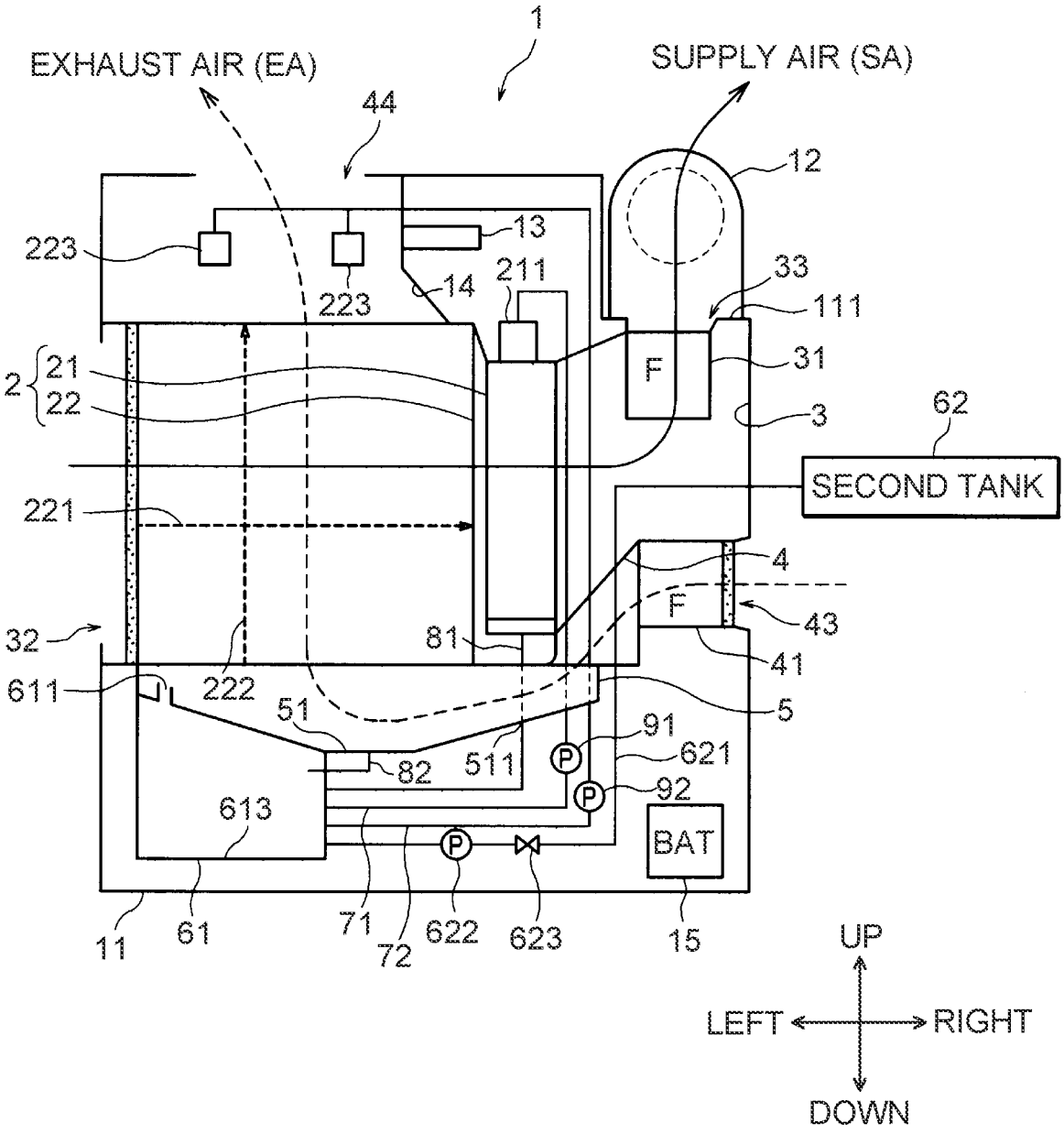
FIG. 1 is a schematic side sectional view illustrating an air conditioner according to an embodiment.
Figure 2:
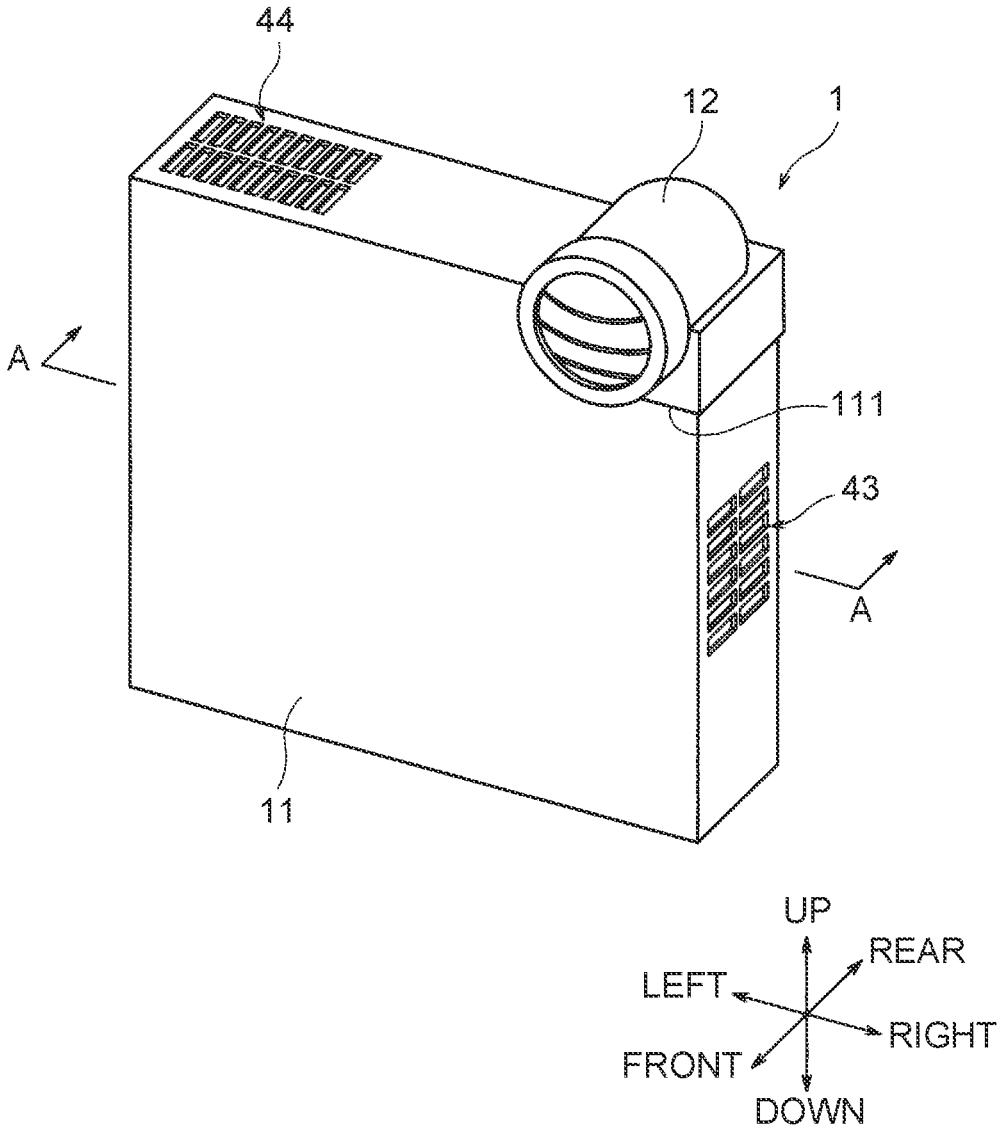
FIG. 2 is an external perspective view of a housing of the air conditioner.

Hereinafter, an embodiment will be described with reference to the drawings. FIG. 1 is a schematic side sectional view illustrating an air conditioner 1 according to an embodiment. FIG. 2 is an external perspective view of a housing 11 of the air conditioner 1. FIG. 1 schematically shows a cross section taken along the line A-A in FIG. 2 as viewed from the front. The air conditioner 1 includes a box-shaped housing 11, and a second tank 62 separate from a body of the housing 11. The air conditioner 1 is mounted on a movable body such as a towing vehicle, a vehicle for high lift work, a mini shovel, or a golf cart, and cools a space around an operator of the movable body as a space to be air-conditioned. Alternatively, the air conditioner 1 may be installed indoors in a factory. In FIG. 1, directional terms, up, down, left, and right, are used to define various parts of the air conditioner 1 in a normal usage mode. In FIG. 2, directional terms, up, down, front, rear, left, and right, are used to define various parts of the air conditioner 1 in a normal usage mode.

The air conditioner 1 includes a first tank 61 for storing water, a second tank 62 for supplying water to the first tank 61, and a cooling unit 2 including an evaporative filter 21 and a sensible heat exchanger 22. The air conditioner 1 uses the heat of evaporation of water supplied from the first tank 61 through the evaporative filter 21 to lower an atmospheric temperature and cool the space to be air-conditioned. Further, the air conditioner 1 uses the sensible heat and the latent heat of the water supplied from the first tank 61 by the sensible heat exchanger 22 to lower the atmospheric temperature and cool the space to be air-conditioned.

The second tank 62 and a part of the communication pipe 621 for supplying water from the second tank 62 to the first tank 61 are provided outside the housing 11 of the air conditioner 1. Other parts or components such as the first tank 61 except for the second tank 62 and the part of the communication pipe 621 are housed inside the housing 11 of the air conditioner 1. A secondary battery 15 such as a lithium battery is housed in the housing 11, and the secondary battery 15 supplies electric power to an actuator such as a first fan 31 to be described later.

The housing 11 of the air conditioner 1 is shaped like a rectangular box made of resin or metal, and has a recessed portion 111, which is devoid of a corner portion, that is, an upper right corner portion in the present embodiment, of the box.

The housing 11 of the air conditioner 1 is provided with a first inlet 32 and a second inlet 43 for taking in air in the space to be air-conditioned. The first inlet 32 is provided in a left side plate which is a left side surface of the housing 11, and the second inlet 43 is provided in a right side plate which is a right side surface of the housing 11. The first inlet 32 and the second inlet 43 are each provided in one of two respective facing side surfaces of the housing 11.

The housing 11 of the air conditioner 1 is provided with a first outlet 33 for blowing out first air that has passed through and is cooled by the cooling unit 2 including the sensible heat exchanger 22 and the evaporative filter 21 to the space to be air-conditioned as supply air SA. The housing 11 of the air conditioner 1 is provided with a second outlet 44 for blowing out second air that has passed through the sensible heat exchanger 22 and has undergone sensible heat exchange with the water and the first air as exhaust air EA. The first outlet 33 is defined in the recessed portion 111 located on the right side of the upper surface of the housing 11. A duct 12 is placed in the recessed portion 111 so as to fill the recessed portion 111, and the duct 12 communicates with the first outlet 33 defined in the recessed portion 111. The second outlet 44 is defined on the left side of the upper surface of the housing 11. Hereinafter, the first air passing through the housing 11 will be referred to as supply air SA, and the second air passing through the housing 11 will be referred to as exhaust air EA.

The first inlet 32 and the first outlet 33 communicate with each other, and a first channel 3 through which the supply air SA flows, that is, a supply air channel, is defined with the first inlet 32 as an entrance for the supply air SA and the first outlet 33 as an exit for the supply air SA. That is, the supply air SA flows from the first inlet 32 into the first channel 3 and flows out from the first outlet 33.

The second inlet 43 and the second outlet 44 communicate with each other, and a second channel 4 through which the exhaust air EA flows, that is, an exhaust air channel is defined with the second inlet 43 as an entrance for the exhaust air EA and the second outlet 44 as an exit for the exhaust air EA. That is, the supply air EA flows from the second inlet 43 into the second channel 4 and flows out from the second outlet 44.

The air conditioner 1 includes a fan for conveying supply air SA and exhaust air EA, and the fan includes a first fan 31 for conveying the supply air SA and a second fan 41 for conveying the exhaust air EA. The first fan 31 for conveying the supply air SA functions as an air supply fan and is, for example, an axial flow fan such as a propeller fan. The first fan 31 is provided in the vicinity of the first outlet 33, is located downstream of the sensible heat exchanger 22 in a flow direction of the supply air SA in the first channel 3, and functions as a suction fan. The first fan 31 is provided adjacent to a lower surface of the recessed portion 111.

The second fan 41 for conveying the exhaust air EA functions as an exhaust fan and is, for example, a propeller fan. The second fan 41 is provided in the vicinity of the second inlet 43, is located upstream of the sensible heat exchanger 22 in a flow direction of the second air in the second channel 4, and functions as an extrusion fan. A dust collecting filter for collecting dust in the exhaust air EA taken in from the second inlet 43 may be disposed between the second fan 41 and the second inlet 43.

The sensible heat exchanger 22 is provided with a first path 221 through which supply air SA flows, and a second path 222 through which exhaust air EA flows. As described above, the air conditioner 1 is provided with the first channel 3 through which the supply air SA flows and the second channel 4 through which the exhaust air EA flows as ventilation channels. The first path 221 of the sensible heat exchanger 22 constitutes a part of the first channel 3, and the second path 222 of the sensible heat exchanger 22 constitutes a part of the second channel 4.

The first path 221 and the second path 222 in the sensible heat exchanger 22 are defined by a plurality of hollow resin plates disposed in parallel. By thinning the resin plates, heat conductivity can be improved, and the weight of the sensible heat exchanger 22 can be reduced. The hollow structure may be created by metal plates.

A resin plate defining the first path 221 and a resin plate defining the second path 222 are stacked such that the first path 221 extends perpendicular to the flow direction of the exhaust air EA and the second path 222 extends perpendicular to the flow direction of the supply air SA, and sensible heat exchange between the supply air SA and the exhaust air EA is performed via the resin plates. Since the first path 221 and the second path 222 are orthogonal to each other, a crossflow is formed by the supply air SA flowing through the first path 221 and the exhaust air EA flowing through the second path 222.

In each of the resin plates defining the first path 221 and the second path 222, a resin frame may be provided between the resin plates adjacent to each other, and the resin frame may function as a spacer for maintaining a distance between the resin plates. By using a resin frame as a spacer, the sensible heat exchanger 22 can be reduced in weight. The spacer plays a role of regulating the flow of air inside the sensible heat exchanger 22, so that the flow of air inside the sensible heat exchanger 22 becomes uniform, and the area for heat exchange between the supply air SA and the exhaust air EA can be increased. A spacer for the exhaust air EA may be thicker than a spacer for the supply air SA. That is, the spacer for the exhaust air EA may be wider than the spacer for the supply air SA. With such a configuration, the pressure drop of the exhaust air EA flowing through the sensible heat exchanger 22 can be reduced, and the volume of the exhaust air EA can be increased more than the volume of the supply air SA. With such a configuration, the supply air SA can be further efficiently cooled by the exhaust air EA, and the temperature of the supply air SA can be further lowered. In the present embodiment, the sensible heat exchanger 22 is of a plate type using resin plates. However, the sensible heat exchanger 22 is not limited thereto, and may have a configuration in which, for example, cylindrical paths having a straw shape are provided side by side.

Two opposing side surfaces of the sensible heat exchanger 22 are each provided with one of an entrance and an exit of the first path 221. In the illustration of the present embodiment, the entrance of the first path 221 is provided on the left side surface of the sensible heat exchanger 22, and the exit of the first path 221 is provided on the right side surface of the sensible heat exchanger 22. A dust collecting filter for collecting dust in the supply air SA taken in from the first inlet 32 may be disposed between the entrance of the first path 221 and the first inlet 32.

The first path 221 is defined by stacked spaces extending from the entrance on the left side surface of the sensible heat exchanger 22 toward the exit on the right side surface thereof. A lower surface of the sensible heat exchanger 22 is provided with an entrance for the exhaust air EA in the second path 222, and an upper surface of the sensible heat exchanger 22 is provided with an exit for the exhaust air EA in the second path 222. The second path 222 is defined by stacked spaces extending from the entrance on the lower surface of the sensible heat exchanger 22 toward the exit on upper surface thereof.

A box-shaped drain pan 5 having an opening at the top is provided below the sensible heat exchanger 22. The drain pan 5 is disposed upstream of the sensible heat exchanger 22 in the flow direction of the exhaust air EA with its opening toward the lower surface of the sensible heat exchanger 22. The exhaust air EA taken in from the second inlet 43 and conveyed by the second fan 41 passes through the internal space of the box-shaped drain pan 5, and flows into the second path 222 from the entrance for the exhaust air EA in the second path 222 provided on the lower surface of the sensible heat exchanger 22. That is, the internal space of the drain pan 5 forms a part of the second path 222.

The exhaust air EA that has passed through the second path 222 of the sensible heat exchanger 22 passes through a space in which the second water supply part 223 that supplies water to the second path 222 is provided, and is blown out from the second outlet 44. Details of the second water supply part 223 will be described later.

A substrate 13 on which a controller 131 for controlling the air conditioner 1 is mounted is thermally connected to a wall surface defining the second channel 4 downstream of the second path 222 of the sensible heat exchanger 22 in the flow direction of the exhaust air EA. The wall surface thermally connected to the substrate 13 may be, for example, a partition plate 14 for separating a space in which the second water supply part 223 is provided from a space in which the substrate 13 is disposed. Since the exhaust air EA cooled by the heat of evaporation of water from the second water supply part 223 flows through the second channel 4 located downstream of the second path 222 of the sensible heat exchanger 22, the substrate 13 can be cooled by the exhaust air EA.

In the illustrated example of the present embodiment, the first path 221 through which the supply air SA flows is provided linearly from the left side surface of the sensible heat exchanger 22 to the right side surface. In the flow direction of the supply air SA, the evaporative filter 21 is provided at the terminal end of the first path 221 of the sensible heat exchanger 22, that is, downstream of the exit of the first path 221. The evaporative filter 21 is provided in the first path 221, and is provided between the sensible heat exchanger 22 and the first fan 31.

The evaporative filter 21 is provided such that one surface of a rectangular filter element faces the side surface of the sensible heat exchanger 22 provided with the exit of the first path 221. The evaporative filter 21 thus provided with the filter element functions as a cooling element. The filter element of the evaporative filter 21 is formed of rayon polyester, nonwoven fabric, or other material. A first water supply part 211 having a water supply hole is provided above the evaporative filter 21. The filter element of the evaporative filter 21 is absorbent, and water supplied from the first water supply part 211 permeates all over the evaporative filter 21, thereby promoting evaporation of water.

The evaporative filter 21 is provided in the first channel 3 upstream of the first fan 31 in the flow direction of the supply air SA. Therefore, the pressure inside of the evaporative filter 21 becomes negative with respect to the atmospheric pressure, and the water temporarily held in the first water supply part 211 is taken into the evaporative filter 21 through the water supply hole of the first water supply part 211, thus allowing water to efficiently permeate into the evaporative filter 21. Thus, the amount of water supply can be adjusted in accordance with the degree of negative pressure due to the number of rotations of the first fan 31 and the wind speed. In the present embodiment, a mechanism for supplying water at a negative pressure is adopted, but various configurations such as a mechanism for supplying water using the weight of water can also be adopted.

The first channel 3 from the evaporative filter 21 to the first outlet 33 extends upward from the evaporative filter 21. The first fan 31 for conveying the supply air SA is provided in a downstream portion of the first channel 3 from the evaporative filter 21 to the first outlet 33. The first fan 31 is provided partially above the evaporative filter 21. The evaporative filter 21 and the first fan 31 overlap each other in the height direction. Thus, the lowermost portion of the first fan 31 can be positioned below the uppermost portion of the evaporative filter 21. This prevents upsizing of the air conditioner 1 compared to a case where the lower surface of the first fan 31 is positioned above the upper surface of the evaporative filter 21. The recessed portion 111 for placing the duct 12 can be defined in an upper portion of the housing 11.

The first air that has flowed out from the first path 221 of the sensible heat exchanger 22 passes through the evaporative filter 21 and is blown out as supply air SA from the first outlet 33 to the space to be air-conditioned. The first air flowing out from the exit of the first path 221 is primarily cooled by the exhaust air EA via the sensible heat exchanger 22, and is further secondarily cooled by the evaporative filter 21, thereby the supply air SA is cooled in two stages.

As described above, the air conditioner 1 includes the first tank 61 for storing water to be supplied to the evaporative filter 21 and the sensible heat exchanger 22. The first tank 61 is disposed below the drain pan 5. The first tank 61 stores water conveyed through water collecting channels for collecting water remaining in the cooling unit 2. The water collecting channels include a first water collecting channel 81 and a second water collecting channel 82. The first tank 61 and the evaporative filter 21 communicate with each other via the first water collecting channel 81. The first tank 61 and the drain pan 5 communicate with each other via the second water collecting channel 82. Although the details will be described later, the water remaining in the cooling unit 2 is water that has been supplied from the first tank 61 to the evaporative filter 21 and the sensible heat exchanger 22 and has passed therethrough, remaining unevaporated in liquid form. The water remaining in the cooling unit 2 is evaporative filter-remaining water, which remains in the evaporative filter, and second path-remaining water, which remains in the second path.

The first tank 61 is disposed below the evaporative filter 21 and the sensible heat exchanger 22. Thus, the evaporative filter-remaining water remaining unevaporated in liquid form in the evaporative filter 21 flows into the first tank 61 through the first water collecting channel 81 by gravity. The evaporative filter 21 and the drain pan 5 located below the sensible heat exchanger 22 are disposed above the first tank 61. Thus, the second path-remaining water remaining unevaporated in liquid form in the second path of the sensible heat exchanger 22 flows into the first tank 61 through the drain pan 5 and the second water collecting channel 82 by gravity.

Water conveyed to the first tank 61 is supplied to the cooling unit 2 through water supply channels. The supply water channels include a first supply water channel 71 communicating with the evaporative filter 21 and a second supply water channel 72 communicating with the sensible heat exchanger 22. A first circulator pump 91 and a second circulator pump 92 are provided in the first supply water channel 71 and the second supply water channel 72, respectively, which constitute the supply water channels. Water in the first tank 61 is supplied to the first water supply part 211 on or above the evaporative filter 21 by driving the first circulator pump 91 provided in the first supply water channel 71. Water in the first tank 61 is supplied to the second water supply part 223 above the sensible heat exchanger 22 by driving the second circulator pump 92 provided in the second supply water channel 72. A valve that restricts the flow rate of water may be provided in one or both of the first supply water channel 71 and the second supply water channel 72.

The cooling unit 2 and the first tank 61 communicate with each other through the supply water channels and the water collecting channels, thereby forming circulating water channels for circulating water between the cooling unit 2 and the first tank 61. The circulating water channels are constituted by an evaporative filter 21-based water channel as a first circulating water channel and a sensible heat exchanger 22-based water channel as a second circulating water channel. The first circulating water channel is defined by the first tank 61, the first circulator pump 91, the first supply water channel 71, the first water supply part 211, the evaporative filter 21 and the first water collecting channel 81. The second circulating water channel is defined by the first tank 61, the second circulator pump 92, the second supply water channel 72, the second water supply part 223, the second path 222 of the sensible heat exchanger 22, and the second water collecting channel 82.

In a volumetric flow rate per unit time of the water conveyed by the driving of the first circulator pump 91 and the second circulator pump 92, the volumetric flow rate of the first supply water channel 71, which is the evaporative filter 21-based water channel, is smaller than the volumetric flow rate of the second supply water channel 72, which is the sensible heat exchanger 22-based water channel. For example, the volumetric flow rate of the first supply water channel 71 may be 0.5 L/min, and the volumetric flow rate of the second supply water channel 72 may be 0.6 L/min. This can increase the amount of water for cooling the exhaust air EA by the sensible heat in the sensible heat exchanger 22 while controlling the amount of water vapor blown out to the space to be air-conditioned together with the supply air SA, thus further improving the cooling efficiency in the cooling unit 2.

Water supplied from the first supply water channel 71 is temporarily held by the first water supply part 211 provided at the upper portion of the evaporative filter 21, drips in the evaporative filter 21 from the water supply hole provided in the first water supply part 211, and permeates into the evaporative filter 21. The water that has permeated into the evaporative filter 21 is evaporated by the supply air SA passing through the evaporative filter 21, and cools the supply air SA by obtaining latent heat at the time of evaporation from the supply air SA.

The water supplied from the second supply water channel 72 drips into the second path 222 of the sensible heat exchanger 22 through the second water supply part 223 provided above the sensible heat exchanger 22. The second water supply part 223 may include a spray nozzle, atomize the water supplied from the first tank 61 by the spray nozzle, and spray the atomized water into the second path 222. Alternatively, the second water supply unit 223 may have a water supply hole from which water may drip into the second path 222.

Since the second water supply part 223 is provided above the sensible heat exchanger 22, the water dripping or sprayed from the second water supply part 223 flows into the second path 222 from an upper portion of the second path 222, that is, the exit for the exhaust air EA in the second path 222. Thus, in the second path 222 of the sensible heat exchanger 22, the flow direction of the exhaust air EA from bottom to up is opposite to the flow direction of the water dripping from the second water supply part 223 from up to bottom.

As described above, in the second path 222 of the sensible heat exchanger 22, the water dripping from the second water supply part 223 and the exhaust air EA conveyed by the second fan 41 flow in opposite directions to each other. The second path 222 of the sensible heat exchanger 22 is configured to extend in the vertical direction. Water in the second water supply part 223 drips into the second path 222 from above the sensible heat exchanger 22, and the exhaust air EA flows into the second path 222 from below the sensible heat exchanger 22.

Water dripping from above the second path 222 is evaporated by the exhaust air EA flowing into from below the second path 222, and the second air is cooled by the latent heat of evaporation of water. The water dripping from above the second path 222 is the water collected in the first tank 61, and since the water temperature is lower than the temperature of the exhaust air EA, the exhaust air EA is also cooled by sensible heat exchanging with the water. Water that has passed through the second path 222 without being evaporated is received by the drain pan 5 located below the second path 222. The water that has passed through the second path 222 without being evaporated is also cooled by the latent heat of evaporation of the evaporated water.

The cooled exhaust air EA exchanges sensible heat with the supply air SA flowing through the first path 221, and then flows out from above the second path 222. In the second path 222, the flow direction of the water supplied from the second water supply part 223 is opposite to the flow direction of the exhaust air EA, which enables improved relative speed between the water and the exhaust air EA and improved evaporation efficiency of the water and increased amount of evaporation of water per unit time.

From the following bulk formula, it will be described that, when the conditions of the water temperature and the surface area are equal, the amount of evaporation increases in proportion to the relative velocity between the second air as the exhaust air EA and water. The amount of evaporation of water E is expressed by the bulk formula, $E=\rho CU\ (qSTA\times T-qair)\ A$, where E is the amount of evaporation of water [kg/s], ρ is air density [kg/m3], C is bulk coefficient [−], U is water-air relative speed [m/s], qSTA is saturated specific humidity [−], qair is specific humidity [−], and A is water surface area [m2]. This indicates that the amount of evaporation of water E increases with increased relative velocity U of water and air. Further, the thermal resistance in the sensible heat exchange between the water and the second air in a heat exchanger exhaust portion of the second path 222 of the sensible heat exchanger 22 also decreases depending on the relative speed between the water and the second air. For example, the well-known basic formula for thermal resistance ($R=1/hS$) indicates that the thermal resistance due to sensible heat exchange decreases with increased relative velocity between water and air. In the second path 222, the flow direction of the water supplied from the second water supply part 223 is opposite to the flow direction of the second air, so that the relative speed between the water and the second air can be improved to increase the amount of evaporation of water per unit time, and the thermal resistance of the sensible heat exchange between the water and the second air can be reduced to improve the cooling efficiency for the second air. The second air cooled in this way cools the first air as the supply air SA, which enables improved cooling capacity of the air conditioner 1.

Heat insulating members may be attached to outer peripheral surfaces of the first tank 61, that is, the outer surfaces of the bottom plate 613 and the side plates of the first tank 61. As described above, the first tank 61 stores water conveyed from the evaporative filter 21 and the sensible heat exchanger 22, and the water is cooled by the heat of evaporation. The heat insulating members on the outer peripheral surfaces of the first tank 61 can control heat exchange between the water conveyed from the evaporative filter 21 and the air around the first tank 61 via the bottom plate 613 and the side plates of the first tank 61, and prevent an increase in the temperature of the water conveyed from the evaporative filter 21. Similarly, the heat insulating members may be attached to the outer peripheral surfaces of the drain pan 5, the first supply water channel 71, the second supply water channel 72, and the second water collecting channel 82.

The drain pan 5 is shaped like a box having an opening at an upper portion thereof, and is disposed such that the opening faces the sensible heat exchanger 22 and the evaporative filter 21. The drain pan 5 is disposed below the sensible heat exchanger 22 and the evaporative filter 21, which are arranged side by side in the left-right direction, and receives the second path-remaining water, which has not been evaporated in the sensible heat exchanger 22 during passage through the sensible heat exchanger 22, from the opening. That is, water not evaporated and dripping from the inlet for the second air in the second path 222 of the sensible heat exchanger 22 flows into the drain pan 5, and is temporarily stored in the drain pan 5.

A bottom plate 51 of the box-shaped drain pan 5 has a flat part at a central part and inclined parts positioned at both right and left ends of the flat part. Each of the inclined parts located at both ends of the flat part is inclined upward toward a corresponding side plate of the drain pan 5, and thus the flat part is configured as the lowermost part of the bottom plate 51. The water received by the drain pan 5 thus flows down from the inclined parts to the flat part. The flat part is provided with the second water collecting channel 82 communicating with the first tank 61, and the water received by the drain pan 5 is conveyed to the first tank 61 through the second water collecting channel 82.

The evaporative filter-remaining water, which has not been evaporated at the evaporative filter 21 during passage through the evaporative filter 21 from up to bottom, is conveyed to the first tank 61 through the first water collecting channel 81 provided below the evaporative filter 21 without remaining in the drain pan 5. The first water collecting channel 81 extending from below the evaporative filter 21 enters the internal space of the drain pan 5 from the opening of the drain pan 5, passes through a through hole 511 provided in the bottom plate 51 of the drain pan 5, and communicates with the first tank 61. That is, since the first water collecting channel 81 passes through the bottom plate 51 of the drain pan 5, the evaporative filter-remaining water flowing in the first water collecting channel 81 is conveyed from the evaporative filter 21 into the first tank 61 without flowing into the drain pan 5. The first water collecting channel 81 is thus partially located in the internal space of the drain pan 5 and passes through the bottom plate 51, so that the first water collecting channel 81 can function as a bypass passage that bypasses the drain pan 5. The provision of the bypass passage can prevent the first water collecting channel 81 and the second water collecting channel 82 from crossing in the drain pan 5, and reliably prevent the exhaust air EA flowing in the internal space of the drain pan 5 from flowing into the first water collecting channel 81 and further flowing into the first channel 3. Here, the internal space of the drain pan 5 is under positive pressure due to the first fan 31, and the first channel 3 of the evaporative filter 21 is under negative pressure due to the second fan 41. If the first water collecting channel 81 does not pass through the drain pan 5 and communicates with the internal space of the drain pan 5, part of the exhaust air EA may enter the first channel 3 via the evaporative filter 21 without passing through the second path 222 of the sensible heat exchanger 22. In contrast, the first water collecting channel 81 functions as a bypass passage that bypasses the drain pan 5 as described above, reliably preventing part of the exhaust air EA from entering the first channel 3 via the evaporative filter 21 without passing through the second path 222 of the sensible heat exchanger 22.

The internal space of the drain pan 5 having a box shape serves as a channel for the exhaust air EA conveyed by the second fan 41 and forms part of the second path 222. The drain pan 5 provided below the sensible heat exchanger 22 is longer than the sensible heat exchanger 22 in the left-right direction. This enables increasing the length of a path in the internal space of the drain pan 5 forming a part of the second path 222. Thus, the exhaust air EA passing through the internal space of the drain pan 5 can be cooled efficiently with the water retained in the drain pan 5, thus improving the cooling efficiency.

The exhaust air EA blown out from the second fan 41 flows into the internal space of the drain pan 5 from the opening of the drain pan 5 close to the second fan 41, passes through the internal space, and then flows into the second path 222 from below the second path 222 of the sensible heat exchanger 22. The drain pan 5 temporarily stores the second path-remaining water flowing from the second water collecting channel 82, and the second path-remaining water in the drain pan 5 is cooled by the heat of evaporation. The exhaust air EA passing through the internal space of the drain pan 5 is cooled by sensible heat exchange with the second path-remaining water gathering in the drain pan 5 and further by the heat of evaporation generated by evaporation of part of the water. Further, a part of the first water collecting channel 81 is provided in the internal space of the drain pan 5, and the evaporative filter-remaining water, which has not been evaporated in the evaporative filter 21 during passage through the evaporative filter 21, flows in the first water collecting channel 81, and the evaporative filter-remaining water is cooled by the heat of evaporation. The exhaust air EA passing through the internal space of the drain pan 5 is further cooled by sensible heat exchange with the evaporative filter-remaining water flowing in the first water collecting channel 81. The exhaust air EA is thus cooled, before flowing into the second path 222 of the sensible heat exchanger 22, by cold energy of the second path-remaining water gathering in the drain pan 5 and the evaporative filter-remaining water flowing through the first water collecting channel 81. The exhaust air EA flowing in the second path 222 can improve the cooling capacity for the supply air SA flowing through the first path 221.

The first tank 61 is disposed below the drain pan 5 and is accommodated in the housing 11. The first tank 61 forms a sealed box made of resin, for example, and is disposed in close contact with the outer surface of the bottom plate 51 of the drain pan 5. The first tank 61 is disposed such that an outer surface of its upper plate is in close contact with the outer surface of the left inclined portion of the bottom plate 51 of the drain pan 5. The upper plate of the first tank 61 and the left inclined portion of the bottom plate 51 of the drain pan 5 may be integrally molded, for example.

The first tank 61 has an air hole 611 in an upper surface of the first tank 61 above a region where water is to be stored in the first tank 61. The air hole 611 passes through the bottom plate 51 of the drain pan 5 to allow the inside and the outside of the first tank 61 to communicate with each other, and communicates with the internal space of the drain pan 5. If the air hole 611 were not provided, the pressure in the first tank 61 would increase, making it harder for water to flow from the first water collecting channel 81 and the second water collecting channel 82 into the first tank 61. In contrast to this, the provision of the air hole 611 as described above can prevent the pressure in the first tank 61 from increasing, thus making it easy for water to flow into the first tank 61 from the first water collecting channel 81 and the second water collecting channel 82. The air hole 611 that allows the first tank 61 and the drain pan 5 to communicate with each other is located in an end portion of the inclined portion of the bottom plate 51 of the drain pan 5 adjacent to a side plate of the drain pan 5. As the air hole 611 is located at a relatively elevated position in a depth direction of the drain pan 5, that is, in the vertical direction, water can be prevented from flowing through the air hole 611. In the present embodiment, the air hole 611 provided in the first tank 61 communicates with the drain pan 5. The air hole 611, however, may communicate with any space in the housing 11.

The first tank 61 is connected to a communication pipe 621 communicating with the second tank 62, in addition to the first supply water channel 71, the second supply water channel 72, the first water collecting channel 81, and the second water collecting channel 82. The communication pipe 621 is inserted into the first tank 61. The communication pipe 621 is provided with a water supply pump 622 and a solenoid valve 623. When the solenoid valve 623 is opened and the water supply pump 622 is driven, water is supplied from the second tank 62 to the first tank 61.

The following describes connection of the first tank 61 with the first supply water channel 71, the second supply water channel 72, the first water collecting channel 81, and the second water collecting channel 82. The second water collecting channel 82 extends into the first tank 61. Since the opening of the second water collecting channel 82 is located adjacent to the drain pan 5, even if the housing 11 is inclined, water in the first tank 61 can be prevented from flowing into the drain pan 5 through the opening of the second water collecting channel 82. The first supply water channel 71, the second supply water channel 72, the first water collecting channel 81, and the communication pipe 621 are connected to the first tank 61 without extending into the first tank 61. Even if the housing 11 is inclined, water in the first tank 61 can be prevented from flowing backward to the first supply water channel 71, the second supply water channel 72, and the communication pipe 621 by check valves in the first circulator pump 91, the second circulator pump 92, and the water supply pump 622. Further, since the evaporative filter 21 is disposed above the first water collecting channel 81, water flowing backward in the first water collecting channel 81 can be prevented from flowing upward into the evaporative filter 21.

The second tank 62 forms a sealed box made of resin, for example, and is placed outside the housing 11. The second tank 62 may have a capacity larger than the first tank 61. The communication pipe 621 is inserted into the second tank 62, and the second tank 62 and the first tank 61 communicate with each other through the communication pipe 621.

The air conditioner 1 takes in air in the air-conditioned space from the first inlet 32 and the second inlet 43. The air taken in from the first inlet 32 flows into the first channel 3 as supply air SA. The air taken in from the second inlet 43 flows into the second channel 4 as exhaust air EA.

The exhaust air EA taken in from the second inlet 43 passes through the internal space of the drain pan 5. Since the drain pan 5 receives the second path-remaining water conveyed from the sensible heat exchanger 22, the exhaust air EA is cooled by the conveyed water when passing through the internal space of the drain pan 5. In addition, since the first water collecting channel 81 is provided in the internal space of the drain pan 5, the exhaust air EA is further cooled by the evaporative filter-remaining water flowing through the first water collecting channel 81. The exhaust air EA that has passed through the internal space of the drain pan 5 flows into the second path 222 from below the sensible heat exchanger 22.

Water supplied from the first tank 61 drips into the second path 222 via the second water supply part 223 provided above the sensible heat exchanger 22. That is, the exhaust air EA and the water dripping from the second water supply part 223 are mixed in the second path 222, in which the exhaust air EA and the water flow in the opposite directions. The water stored in the first tank 61 is water conveyed from the evaporative filter 21 and the sensible heat exchanger 22, and is water cooled by the heat of evaporation. Thus, the temperature of the water supplied from the first tank 61 is lower than the temperature of the exhaust air EA immediately after flowing into the second path 222. The exhaust air EA exchanges sensible heat with the water dripping from the second water supply unit 223, that is, is cooled by the water.

Since the water dripping from the second water supply part 223 flows into the resin plates defining the second path 222, the surface area of the water in contact with the exhaust air EA increases. Thus, some water dripping from the second water supply part 223 evaporates, and the exhaust air EA is cooled by the heat of evaporation. Since the exhaust air EA and the water flow in the opposite directions, the relative speed between the exhaust air EA and the water is increased as compared with a case where the exhaust air EA and the water flow in parallel directions, which can promote evaporation of the water per unit time, that is, increase the latent heat of evaporation, and increase the cooling capacity for the exhaust air EA.

The supply air SA flowing through the first path 221 of the sensible heat exchanger 22 and the exhaust air EA flowing through the second path 222 form a crossflow, and sensible heat is exchanged between the supply air SA and the exhaust air EA. As described above, the exhaust air EA flowing through the second path 222 is cooled by the water supplied from the first tank 61, and the supply air SA is cooled by the exhaust air EA cooled by the water supplied from the first tank 61. Sensible heat is exchanged between the supply air SA and water remaining in the second path 222 without being evaporated.

The supply air SA that has passed through the first path 221 of the sensible heat exchanger 22 flows into the first channel 3 from the sensible heat exchanger 22 to the first outlet 33. In the first channel 3, the evaporative filter 21 is provided downstream of the sensible heat exchanger 22, and the supply air SA passes through the evaporative filter 21.

Water supplied from the first tank 61 drips from the first water supply part 211 provided at the upper portion of the evaporative filter 21 into the evaporative filter 21. Since the inside of the first channel 3 is maintained under negative pressure, the water supplied from the first tank 61 is sucked from the water supply hole provided in the bottom surface of the first water supply part 211 into the evaporative filter 21 and permeates into the evaporative filter 21. When the supply air SA passes through the evaporative filter 21, evaporation of the water having permeated into the evaporative filter 21 is promoted, and the water is evaporated into water vapor and is contained in the supply air SA. The supply air SA is cooled by the heat of evaporation, and the temperature of the supply air SA decreases. The cooled supply air SA is blown out to the space to be air-conditioned from the first outlet 33 by the first fan 31.

With such a configuration, the first air as the supply air SA blown out to the space to be air-conditioned can be cooled in two steps including primary cooling by the sensible heat exchanger 22 and secondary cooling by the evaporative filter 21. This can reduce the temperature of the supply air SA further than a direct evaporation method that uses, for example, only the evaporative filter 21.

Some water supplied from the first tank 61 to the evaporative filter 21 remains unevaporated in the evaporative filter 21 as liquid water. The remaining water is also cooled by the heat of evaporation. The water remaining in the evaporative filter 21 moves to a lower portion of the evaporative filter 21 by gravity, and is conveyed to the first tank 61 through the first water collecting channel 81 provided below the evaporative filter 21. As the water remaining in the evaporative filter 21 is collected in this way, the temperature of the water stored in the first tank 61 can be lowered and stabilized at a relatively low level.

As described above, the water stored in the first tank 61 is supplied to the sensible heat exchanger 22 and the evaporative filter 21, and the cooling capacity of the sensible heat exchanger 22 and the evaporative filter 21 can be improved by stabilizing the water stored in the first tank 61 to have a low temperature.

The exhaust air EA flowing into the second path 222 from below the sensible heat exchanger 22 is conveyed toward the exit of the second path 222 located in an upper portion of the sensible heat exchanger 22. The unevaporated water in the upper portion of the sensible heat exchanger 22 flows into the drain pan 5 provided below the sensible heat exchanger 22, is temporarily retained in the drain pan 5, and is then conveyed to the first tank 61 through the second water collecting channel 82 provided in the bottom plate 51 of the drain pan 5.

The exhaust air EA that has passed through the second path 222 of the sensible heat exchanger 22 flows into the second channel 4 extending from the sensible heat exchanger 22 to the second outlet 44. The second channel 4 is provided above the sensible heat exchanger 22, and the exhaust air EA passes through the second channel 4 and is then blown out from the second outlet 44. In the flow direction in the second channel 4, a substrate 13 is thermally connected to a partition plate 14 which is a wall surface defining the second channel 4 downstream of the sensible heat exchanger 22, and the substrate 13 is cooled by the exhaust air EA.

Figure 3:
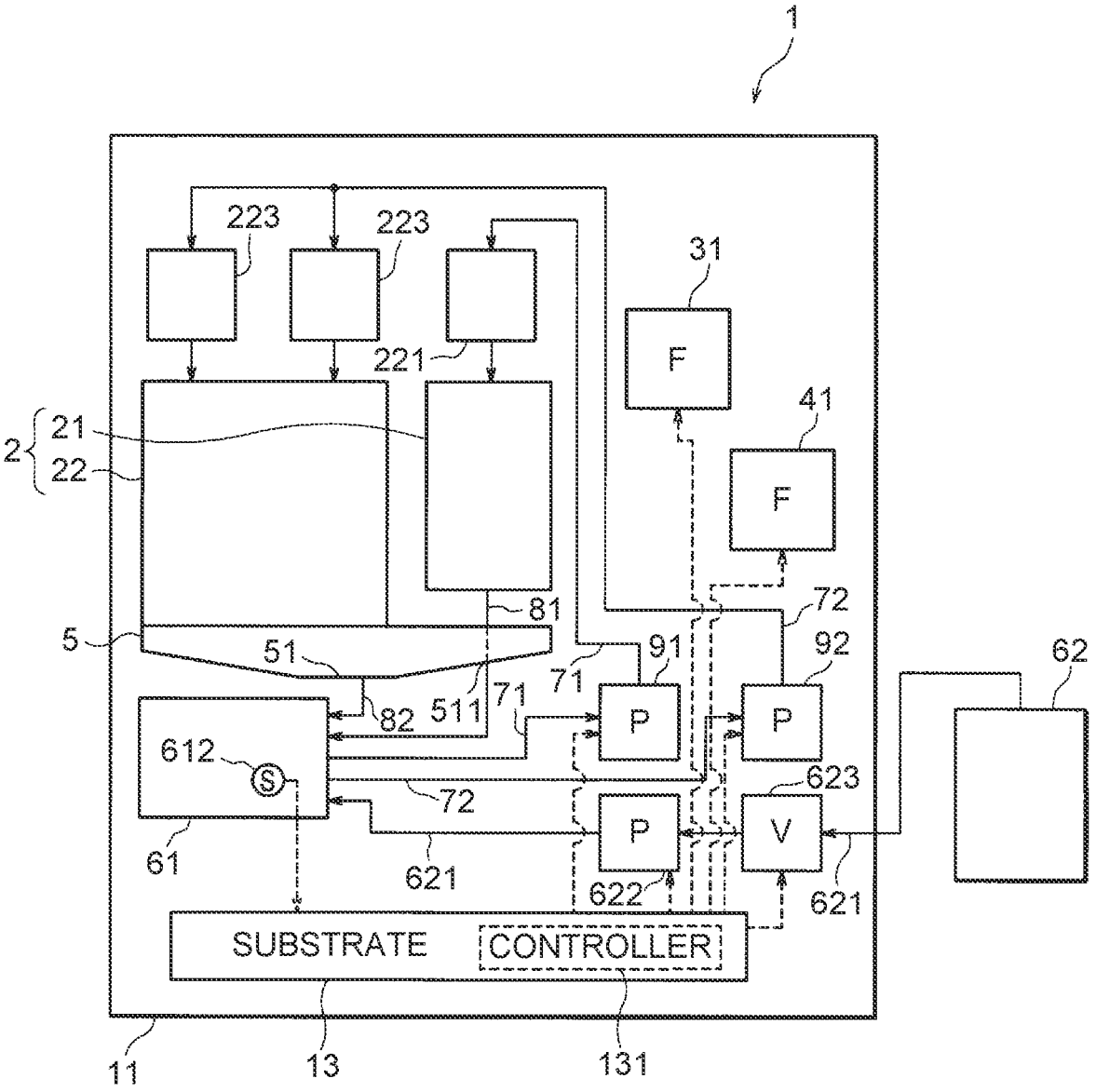
FIG. 3 is a block diagram illustrating functional units in the air conditioner.

FIG. 3 is a block diagram illustrating functional units in the air conditioner 1. The air conditioner 1 includes, as electrical components, the first fan 31, the second fan 41, the first circulator pump 91, the second circulator pump 92, the water supply pump 622, the electromagnetic valve 623, and a water level sensor 612, which are communicably connected to the controller 131 provided on the substrate 13 via communication lines.

The water level sensor 612 is constituted by, for example, a float switch, and is provided inside the first tank 61. The substrate 13 is populated with a microcomputer including a memory and an MPU. The microcomputer functions as the controller 131 that controls driving of the water supply pump 622, the electromagnetic valve 623, and other electrical components.

The controller 131 may control the supply and interruption of power from the secondary battery 15 to the first fan 31, the second fan 41, the first circulator pump 91, the second circulator pump 92, and the water supply pump 622 to control the driving of these actuators. In response to a signal output from the water level sensor 612 in the first tank 61, the controller 131 controls the water supply pump 622 and the electromagnetic valve 623 provided in the communication pipe 621 to start and stop water supply from the second tank 62 to the first tank 61.

Figure 4:
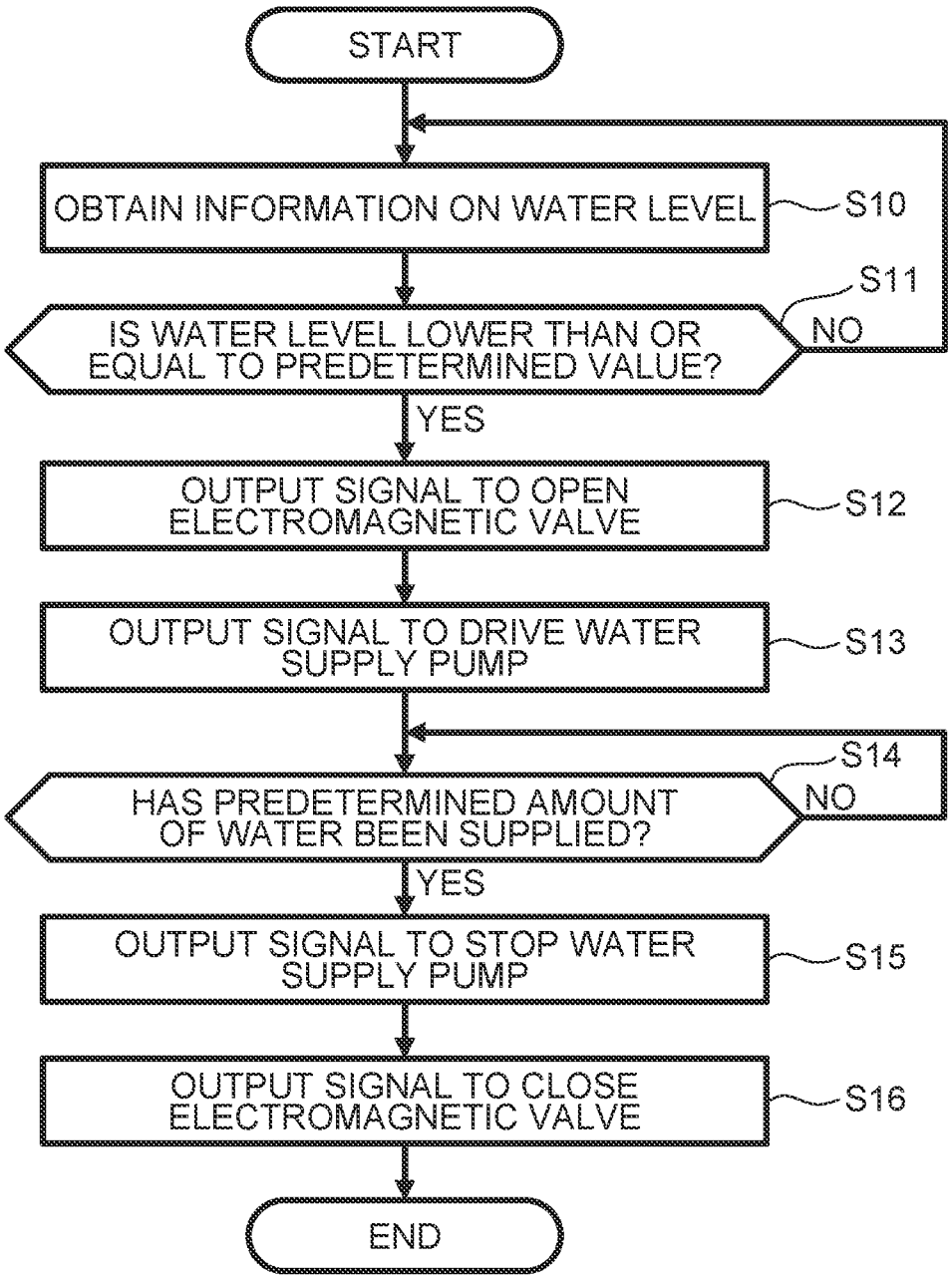
FIG. 4 is a flowchart illustrating steps performed by a controller mounted on a substrate.

FIG. 4 is a flowchart illustrating a processing procedure performed by the controller 131 mounted on the substrate 13. The controller 131 mounted on the substrate 13 executes the following processing periodically or constantly during the operation of the air conditioner 1.

The controller 131 obtains information on a water level of the first tank 61 (S10). The controller 131 obtains information on the level of the water stored in the first tank 61 from the water level sensor 612 provided inside the first tank 61 via a signal line.

The controller 131 determines whether the water level of the first tank 61 is lower than or equal to a predetermined value (S11). For example, the water level sensor 612 configured by a float switch outputs a signal when the water level of the first tank 61 is lower than or equal to the predetermined value. The controller 131 determines whether the water level of the first tank 61 is lower than or equal to the predetermined value based on whether the controller 131 has received the signal from the water level sensor 612. In response to determining that the water level of the first tank 61 is not lower than or equal to the predetermined value (S11: NO), that is, the water level of the first tank 61 exceeds the predetermined value, the controller 131 performs a loop process in order to execute step S10 again.

In response to determining that the water level of the first tank 61 is lower than or equal to the predetermined value (S11: YES), the controller 131 outputs a signal to open the electromagnetic valve 623 (S12). The controller 131 outputs a signal to drive the water supply pump 622 (S13). In response to determining that the water level of the first tank 61 is lower than or equal to the predetermined value, that is, in response to receiving a signal indicating that the water level is lower than or equal to the predetermined value from the water level sensor 612, the controller 131 detects that the first tank 61 is short of water (water absence detection). In response to the water absence detection, the controller 131 outputs a signal to open the electromagnetic valve 623, and further outputs a signal to drive the water supply pump 622, thereby starting water supply from the second tank 62 to the first tank 61.

The controller 131 determines whether a predetermined amount of water has been supplied (S14). The controller 131 determines whether a predetermined amount of water has been supplied by, for example, measuring the driving time of the water supply pump 622. Alternatively, the controller 131 may determine whether a predetermined amount of water has been supplied based on a signal output from the water level sensor 612 provided inside the first tank 61. The predetermined amount of water to be supplied may be determined in advance as, for example, 100 cc. The predetermined amount of water to be supplied may be determined to be lower than or equal to an amount calculated by subtracting, from the capacity of the first tank 61, the amount of water remaining in the first tank 61 at the time when the absence of water is detected and the amount of water remaining in the circulating water channel constituted by the supply water channels and the water collecting channels.

When the predetermined amount of water has not been supplied (S14: NO), the controller 131 performs loop processing to execute step S14 again.

When the predetermined amount of water has been supplied (S14: YES), the controller 131 outputs a signal to stop the water supply pump 622 (S15). The controller 131 outputs a signal to close the electromagnetic valve 623 (S16). When the predetermined amount of water has been supplied, the controller 131 outputs a signal to stop the water supply pump 622, thereby stopping the water supply from the second tank 62 to the first tank 61. Then, the controller 131 outputs a signal to close the electromagnetic valve 623. In stopping the water supply pump 622 and closing the solenoid valve 623, the controller 131 outputs signals. The controller 131, however, may stop drive signals to drive the water supply pump 622 and the solenoid valve 623, thus stopping the water supply pump 622 and closing the solenoid valve 623.

Modification

The embodiments of the disclosure are not limited to the above description, and may be replaced with the following modifications. In the air conditioner 1 according to the present embodiment, the replacement of an element in a modification is not applied only to the modification, but a combination of modifications may be applied to a modification.

The present embodiment includes, but is not limited to, that the secondary battery 15 is housed inside the housing 11. The secondary battery 15 may be attached to the outside the housing 11. The secondary battery 15 externally attached can be easily replaced. In a case where the secondary battery 15 is attached to the outside of the housing 11 as described above, the secondary battery 15 may be detachably attached to, for example, an outer wall of the housing 11 or a basket-shaped bracket for holding the housing 11.

The present embodiment includes, but is not limited to, that the first fan 31 and the second fan 41 are propeller fans. The first fan 31 and the second fan 41 may be, for example, centrifugal fans such as sirocco fans, turbo fans, or cross fans. Axial fans such as propeller fans enable air to flow in the same direction with respect to the first channel 3 and the second channel 4, and thus can contribute to miniaturization. In contrast, centrifugal fans expel air at a right angle to the intake, and thus can be used advantageously for a channel having a right angle turn.

The present embodiment includes, but is not limited to, that the recessed portion 111 for receiving the duct 12 is defined in the upper surface of the housing 11. The recessed portion 111 may be defined in one of the left and right side surfaces of the housing 11. In this case, the duct 12 is attached to a left or right portion of the recessed portion 111 defined in the left or right side surface. The first fan 31 is disposed adjacent to a left or right side surface of the recessed portion 111.

The present embodiment includes, but is not limited to, that the evaporative filter 21 is disposed downstream of the sensible heat exchanger 22. The evaporative filter 21 may be disposed upstream of the sensible heat exchanger 22. Even when the evaporative filter 21 is disposed upstream of the sensible heat exchanger 22 in this way, the supply air SA can be cooled in two steps.

The present embodiment includes, but is not limited to, that the first fan 31 is disposed downstream of the sensible heat exchanger 22 in the flow direction of the supply air SA, and the second fan 41 is disposed upstream of the sensible heat exchanger 22 in the flow direction of the exhaust air EA. The first fan 31 may be disposed upstream of the sensible heat exchanger 22 in the flow direction of the supply air SA, and the second fan 41 may be disposed downstream of the sensible heat exchanger 22 in the flow direction of the exhaust air EA. Alternatively, both the first fan 31 and the second fan 41 may be both disposed upstream or downstream of the sensible heat exchanger 22.

The present embodiment includes, but is not limited to, that the evaporative filter 21 and the first fan 31 overlap each other in the height direction. The evaporative filter 21 and the first fan 31 may not overlap each other in the height direction.

The present embodiment includes, but is not limited to, that the first water collecting channel 81 bypasses the drain pan 5. The first water collecting channel 81 may communicate with the drain pan 5 to allow the evaporative filter-remaining water flowing through the first water collecting channel 81 to flow into the drain pan 5. In this case, the first water collecting channel 81 may be provided with a check valve for restricting the flow of water from the evaporative filter 21 to the drain pan 5 only.

The present embodiment includes, but is not limited to, that the first water collecting channel 81 has at least a portion provided in the internal space of the box-shaped drain pan 5. The first water collecting channel 81 may be disposed upstream or downstream of the sensible heat exchanger 22 in the flow direction of the exhaust air EA, and may not be disposed in the second channel 4. That is, the first water collecting channel 81 may not be provided in the internal space of the drain pan 5, but may be provided outside the internal space of the drain pan 5. The internal space of the drain pan 5 defines a part of the second channel 4.

The present embodiment includes, but is not limited to, that the first water collecting channel 81 passes through the bottom plate 51 of the drain pan 5. At least a part of the first water collecting channel 81 is provided in the internal space of the drain pan 5, but may communicate with the first tank 61 without passing through the bottom plate 51 of the drain pan 5. The first water collecting channel 81 may at least partially have a U or L shaped portion in such a manner that the first water collecting channel 81 extends from the opening of the drain pan 5 into the internal space, and then out of the internal space to the opening, and bypasses a side plate of the drain pan 5 to communicate with the first tank 61. The first water collecting channel 81 can thus increase, in the internal space of the drain pan 5, its length and its heat transfer area with the exhaust gas EA passing through the internal space, improving the cooling efficiency for the exhaust gas EA.

The present embodiment includes, but is not limited to, that the first water collecting channel 81 is a single water channel. In order to increase the efficiency of heat exchange with the exhaust air EA, a group of multiple water channels each having a diameter smaller than that of the first water collecting channel 81 may be used to increase the surface area. Further, the first water collecting channel 81 may be made of a metal having high thermal conductivity.

The present embodiment includes, but is not limited to, that the drain pan 5 is provided upstream of the sensible heat exchanger 22 in the flow direction of the exhaust air EA. The drain pan 5 may be disposed downstream of the sensible heat exchanger 22 in the flow direction of the exhaust air EA, or may not be disposed in the second channel 4.

The present embodiment includes, but is not limited to, that the first tank 61 has the air hole 611. The first tank 61 may not have the air hole 611.

The present embodiment includes, but is not limited to, that the first tank 61 is provided inside the housing 11, and the second tank 62 is provided outside the housing 11. Both the first tank 61 and the second tank 62 may be disposed outside of the housing 11. Alternatively, both the first tank 61 and the second tank 62 may be disposed inside the housing 11.

The present embodiment includes, but is not limited to, that the air conditioner 1 includes the electromagnetic valve 623, the controller 131, and the water level sensor 612. The air conditioner 1 may not include the electromagnetic valve 623, the controller 131, and the water level sensor 612.

The present embodiment includes, but is not limited to, that the air conditioner 1 includes the secondary battery 15. The air conditioner 1 may not include the secondary battery 15 and may include, for example, a power outlet or a power supply port which is a power receiving unit that receives power supply from an external power source such as a commercial power source or a battery of a vehicle on which the air conditioner 1 is to be mounted.

The present embodiment includes, but is not limited to, that the partition plate 14, which is a wall surface thermally connected to the substrate 13, is provided downstream of the sensible heat exchanger 22 in the flow direction of the exhaust air EA. For example, the wall surface thermally connected to the substrate 13 may not be disposed downstream of the sensible heat exchanger 22 in the flow direction of the exhaust air EA. The wall surface may be disposed, for example, upstream of the sensible heat exchanger 22 in the flow direction of the exhaust air EA, upstream of the sensible heat exchanger 22 in the flow direction of the supply air SA, downstream of the sensible heat exchanger 22 in the flow direction of the supply air SA, or in a space other than the first channel 3 and the second channel 4.

The present embodiment includes, but is not limited to, that the housing 11 houses the cooling unit 2 including the sensible heat exchanger 22 and the evaporative filter 21. The housing 11 may house the cooling unit 2 including only the sensible heat exchanger 22 or the evaporative filter 21.

In the present embodiment, the air conditioner 1 includes the housing 11 that houses the cooling unit 2 including at least the sensible heat exchanger 22 or the evaporative filter 21, the first tank 61 that is housed in the housing 11 and stores water to be supplied to the cooling unit 2, and the second tank 62 that is provided outside the housing 11 as a separate body and supplies water to the first tank 61. The first tank 61 and the second tank 62 communicate with each other through the communication pipe 621.

This enables downsizing of the first tank 61 provided in the housing 11, and downsizing of the housing 11 of the air conditioner 1.

The first tank 61 has the air hole 611 extending through a portion above a region of the first tank 61 where water is to be stored.

The air conditioner 1 also includes a solenoid valve 623 provided in the communication pipe 621, the controller 131 that controls opening and closing of the solenoid valve 623, and the water level sensor 612 that outputs information related to the water level in the first tank 61. The controller 131 opens the solenoid valve 623 according to the information related to the water level output from the water level sensor 612 to supply water from the second tank 62 to the first tank 61.

The air conditioner 1 further includes the water supply pump 622 provided in the communication pipe 621 and controlled by the controller 131. The controller 131 drives the water supply pump 622 according to the information on the water level output from the water level sensor 612 to supply water from the second tank 62 to the first tank 61.

It should be understood that the embodiments disclosed herein are illustrative and non-restrictive in every respect. The scope of the present invention is defined by the appended claims rather than by the description above, and is intended to include any modifications within the scope and meaning equivalent to the appended claims.

While the disclosure has been described in detail with reference to the specific embodiment thereof, this is merely an example, and various changes, arrangements and modifications may be applied therein without departing from the spirit and scope of the disclosure.

What is claimed is:

1. An air conditioner, comprising:

a sensible heat exchanger having a first path through which a first air is to flow, and a second path through which a second air is to flow;

an evaporative filter;

a first water supply part configured to supply water to the evaporative filter; and a second water supply part configured to supply water to the second path of the sensible heat exchanger, wherein the second water supply part is disposed with respect to the sensible heat exchanger such that water from the second water supply part and the second air through the second path move in opposite directions, and wherein the first air is to pass through the first path of the sensible heat exchanger and the evaporative filter.

2. The air conditioner according to claim 1, wherein the evaporative filter is disposed downstream of the sensible heat exchanger in a flow direction of the first air flowing in the first path.

3. The air conditioner according to claim 1, further comprising:

a first fan configured to convey the first air; and a second fan configured to convey the second air, wherein the second fan is disposed upstream of the sensible heat exchanger in a flow direction of the second air, and wherein the second water supply part is disposed downstream of the sensible heat exchanger in the flow direction of the second air.

4. The air conditioner according to claim 3, wherein the evaporative filter overlaps the first fan in a height direction of the air conditioner.

5. The air conditioner according to claim 3, further comprising a housing accommodating the sensible heat exchanger and the evaporative filter, the housing having a recessed portion for receiving a duct for blowing out the first air, wherein the first fan is disposed adjacent to the recessed portion.

6. The air conditioner according to claim 1, further comprising:

a first tank configured to store water to be supplied to the first water supply part and the second water supply part;

a drain pan configured to receive water passing through the second path;

a first water collecting channel for conveying water passing through the evaporative filter to the first tank without flowing into the drain pan; and a second water collecting channel for conveying water received at the drain pan to the first tank.

7. The air conditioner according to claim 6, wherein the first water collecting channel is located upstream of the sensible heat exchanger in a flow direction of the second air.

8. The air conditioner according to claim 6, wherein the drain pan is shaped like a box having an opening at an upper portion of the drain pan, and the first water collecting channel has at least a portion provided in an internal space of the drain pan.

9. The air conditioner according to claim 6, wherein the first water collecting channel passes through a bottom plate of the drain pan.

10. The air conditioner according to claim 6, wherein the drain pan is disposed upstream of the sensible heat exchanger in a flow direction of the second air.

11. The air conditioner according to claim 6, wherein the first tank has an air hole extending through a portion above a region where water is to be stored in the first tank.

12. The air conditioner according to claim 1, further comprising:

a housing accommodating the sensible heat exchanger and the evaporative filter;

a first tank configured to store water to be supplied to the first water supply part and the second water supply part; and a second tank configured to store water to be supplied to the first tank, wherein the first tank is disposed in the housing, and wherein the second tank is disposed outside the housing.

13. The air conditioner according to claim 12, further comprising:

an electromagnetic valve disposed between the first tank and the second tank;

a controller configured to control the electromagnetic valve to open and close; and a water level sensor configured to output information on a water level in the first tank, wherein the controller is configured to open the electromagnetic valve to supply water from the second tank to the first tank in response to the information on the water level output from the water level sensor.

14. The air conditioner according to claim 1, further comprising:

a first fan configured to convey the first air;

a second fan configured to convey the second air;

a pump configured to supply water to the first water supply part; and a secondary battery configured to power at least one of the first fan, the second fan, or the pump.

15. The air conditioner according to claim 1, further comprising a housing accommodating the sensible heat exchanger and the evaporative filter, wherein the housing includes a substrate, wherein the substrate is thermally connected to a wall surface defining a channel through which the second air flows, and wherein the wall surface is located downstream of the sensible heat exchanger in a flow direction of the second air.

* * * * *